United States Patent [19]

Pietryka et al.

[11] Patent Number: 4,706,733

[45] Date of Patent: Nov. 17, 1987

[54] CONTINUOUS CASTING MACHINE

[75] Inventors: Joseph Pietryka, Versailles; Joel Cazaux, Chelles, both of France

[73] Assignee: Fives-Cail Babcock, Paris, France

[21] Appl. No.: 3,570

[22] Filed: Jan. 15, 1987

[30] Foreign Application Priority Data

Jan. 17, 1986 [FR] France ..... 86 00611

[51] Int. Cl.[4] ..... B22D 11/04; B22D 11/124

[52] U.S. Cl. ..... 164/416; 164/341; 164/342; 164/436; 164/443; 164/478

[58] Field of Search ..... 164/416, 478, 436, 443, 164/485, 491, 341, 342, 137

[56] References Cited

U.S. PATENT DOCUMENTS

| | | | |
|---|---|---|---|
| Re. 27,469 | 9/1972 | Bode, Jr. | 164/416 |
| 3,800,854 | 4/1974 | Bode, Jr. | 164/416 |
| 3,986,547 | 10/1976 | Pietryka | 164/416 |
| 4,323,107 | 4/1982 | Pietryka | 164/416 |
| 4,480,678 | 11/1984 | Cazaux et al. | 164/416 |
| 4,516,623 | 5/1985 | Scheinecker | 164/416 |

FOREIGN PATENT DOCUMENTS

| | | | |
|---|---|---|---|
| 1508963 | 11/1969 | Fed. Rep. of Germany | 164/416 |

*Primary Examiner*—M. Jordan
*Assistant Examiner*—J. Reed Batten, Jr.
*Attorney, Agent, or Firm*—Kurt Kelman

[57] ABSTRACT

To reduce the cost of the mold, the mold of a continuous casting machine has no frame and the machine comprises an oscillating table constituted by a rectangular frame having large sides and small sides defining an opening, a mold carried by the oscillating table in this opening and comprised of two opposing large plates and two opposing small plates held tightly between the large plates. Supports for the small plates are integral with devices for adjusting the position of the small plates and jacks are provided for exerting a pressing force upon the large plates for pressing them tightly against the small plates. The large plates, the position adjusting devices and the jacks for exerting the pressing force are mounted on the oscillating table.

6 Claims, 6 Drawing Figures

CONTINUOUS CASTING MACHINE

The present invention relates to a continuous casting machine for the production of flat products of rectangular cross section, such as slabs and billets of steel, for example.

Such machines comprise a support frame carrying an oscillating table at the top thereof and an open-ended, water-cooled mold fixed thereto for receiving molten metal from a tundish and discharging a strand of cooled metal to a curved roll rack disposed below the oscillating table for guiding the metal strand along a curved path.

In conventional machines of this type, the mold comprises a frame on which are mounted two opposing large plates and two opposing small plates held tightly between the large plates to form the walls of the mold cavity. The frame carries means for exerting a pressing force upon the large plates for pressing them tightly against the small plates and means for adjusting the position of the small plates with respect to the large plates, i.e. for controlling the distance between the small plates. This frame is fixed to the oscillating table. By displacing the small mold wall plates after the pressure has been removed from the large mold wall plates, it is possible to change the cross section of the mold cavity and thus to change the width of the cast product. The thickness of the cast product may be changed by changing the small plates. When this is to be done, the mold must be disassembled, the small mold wall plates must be changed and the mold must then be replaced on the oscillating table. To reduce the necessary time for this replacement, several molds equipped for the production of billets of different thicknesses are generally kept in store for ready replacement.

The curved roll rack is generally comprised of several parts. The upper part, which is disposed immediately below the mold, is comprised of pinch rolls of small diameter and placed close to each other. When the thickness of the cast product is changed, it is necessary to disassemble this upper roll rack part, too, to adjust the spacing between the pinch rolls. The removal of the upper roll rack part is effected vertically upwardly across the oscillating table after the mold has been removed. The other parts of the curved roll rack comprise pairs of rolls whose spacing may be adjusted without removing these rolls.

The storing of the replacement molds involves a substantial expenditure and it is a primary object of this invention to reduce these costs by doing away with the support frame for the mold.

The above and other objects and advantages are accomplished according to the invention with a continuous casting machine of the indicated type, which comprises an oscillating table constituted by a rectangular frame having large sides and small sides defining an opening, a mold carried by the oscillating table in this opening and consisting of two opposing large plates and two opposing small plates held tightly between the large plates, means for adjusting the position of the small plates with respect to the large plates, supports for the small plates integral with the position adjusting means, and means for exerting a pressing force upon the large plates for pressing them tightly against the small plates, the large plates, the position adjusting means and the means for exerting the pressing force being mounted on the oscillating table.

The means for affixing the large mold wall plates to the oscillating table, on the one hand, and the small mold wall plates to the supports, on the other hand, are designed for rapid assembly and dismounting of the plates as well as to enable cooling water circuits for the plates to be readily connected.

The above and other objects, advantages and features of the present invention will become more apparent from the following detailed description of certain now preferred embodiments thereof, taken in conjunction with the partially schematic accompanying drawing wherein FIG. 1 is a fragmentary side elevational view, partly in section, of the top of a continuous casting machine according to this invention;

Figure 1:
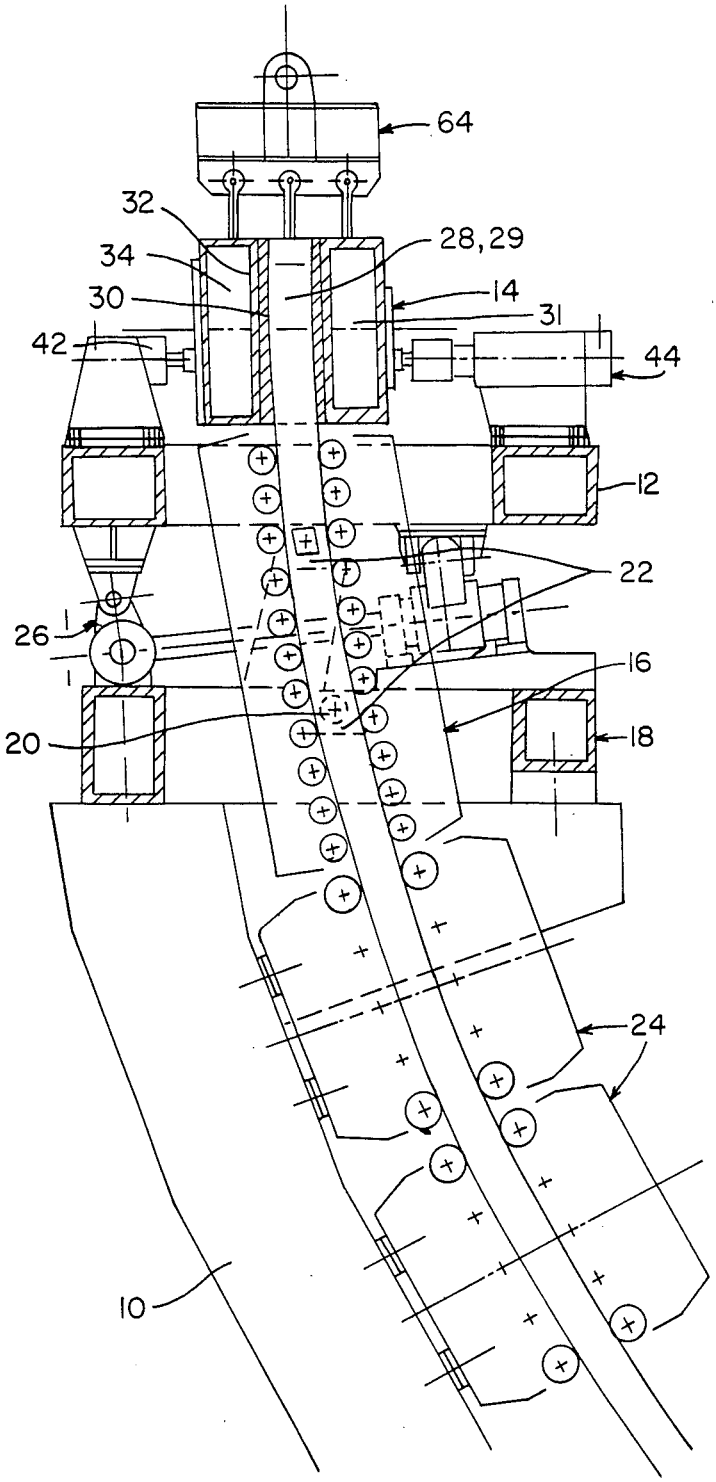

Referring now to the drawing, there is shown a continuous casting machine for producing billets, which comprises a vertical support framework 10 carrying at its top an oscillating table 12 on which is mounted mold 14. The oscillating table is constituted by a rectangular frame having large sides and small sides defining an opening. Framework 10 also carries a curved roll rack disposed below the oscillating table and comprised of upper part 16 and a series of rack sections 24 fixed to framework 10 and each comprised of several pairs of opposing rolls. Upper roll rack part 16 is disposed immediately below mold 14 and extends through upper part 18 of framework 10, which is constituted by a rectangular frame defining an opening aligned with the opening in the oscillating table. This upper rack part comprises a cage carrying two parallel rows of pinch rolls and equipped at opposing sides thereof with two trunnions 20 at each cage side, the trunnions being supported in bearings 22 fixed to the interior of upper framework part 18. The upper rack part may be removed vertically upwardly across oscillating table 12 by lifting it through the openings by an overhead crane after the large mold wall plates have been removed.

Oscillating table 12 is connected to upper framework part 18 by an eccentric mechanism 26 which enables alternating movements of small amplitude to be imposed upon the table. A suitable oscillating mechanism for table 12 has been disclosed, for example, in U.S. Pat. No. 4,480,678.

Figure 2:
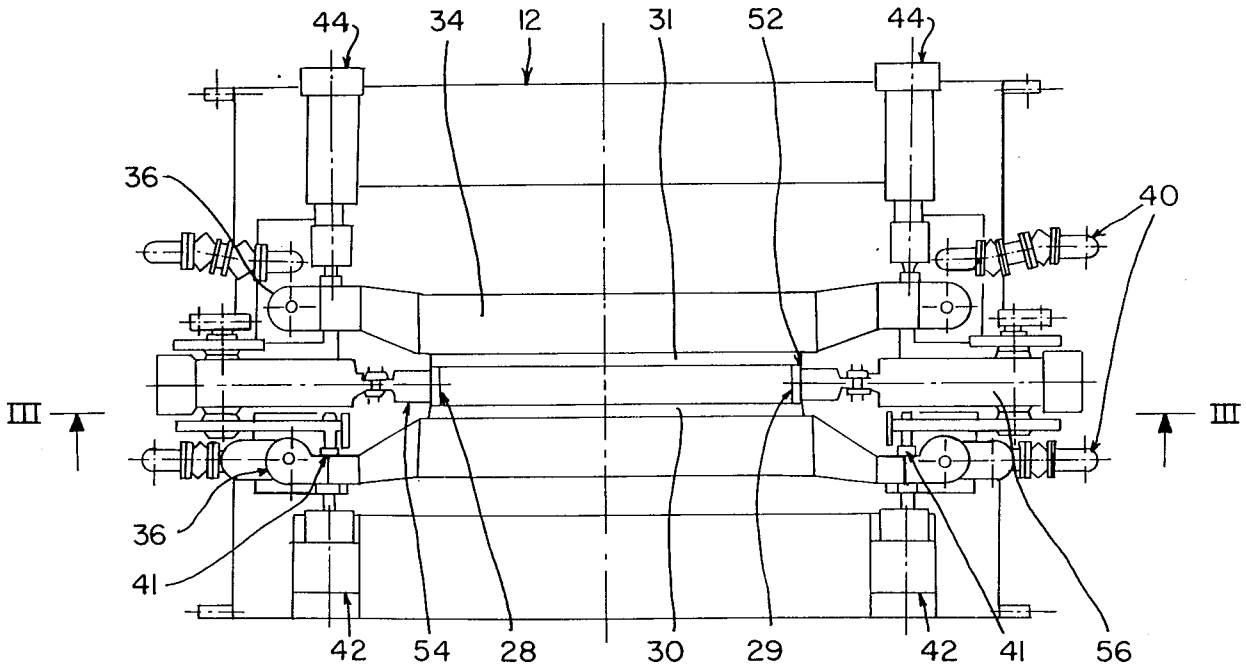
FIG. 2 is a top view of the machine.
Figure 6:
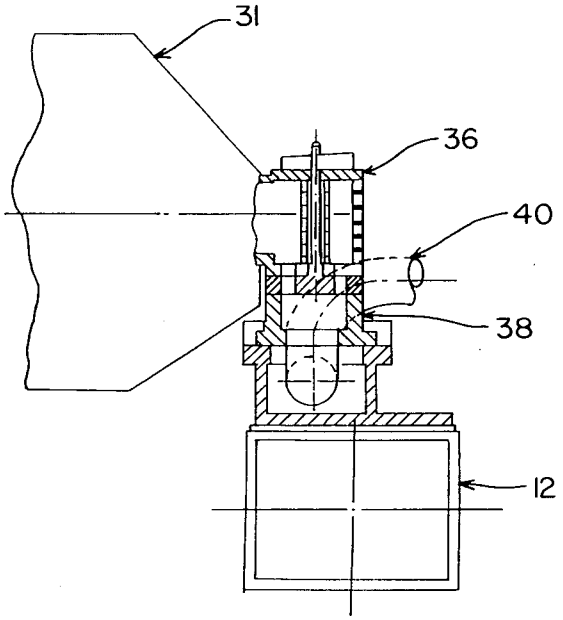
FIGS. 5 and 6 illustrate structural details of the connections between the large mold wall plates and the water-containing casings, partly in section.
Figure 5:
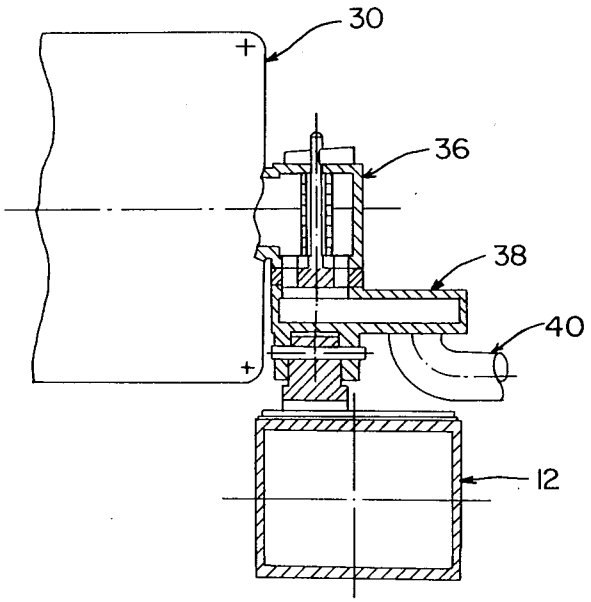

Mold 14 is carried by oscillating table 12 in alignment with the opening and consists of four plates or composite panels, i.e. two opposing large plates 30, 31 and two opposing small plates 28, 29 held tightly between the large plates, the four plates being assembled to define a molding cavity of rectangular cross section. Each large plate 30, 31 is formed by an interior copper plate 32 facing the mold cavity to form a wall thereof and fixed to case 34 of steel serving to impart the required rigidity to the copper mold cavity wall and to circulate cooling water to channels defined in the interior copper plate in a manner generally well known. As best shown in FIGS. 2, 5 and 6, lugs 36 extend from respective opposite ends of steel cases 34 of the large plates. The large mold wall plates are mounted on the small sides of oscillating table 12 by means of hollow lugs 36. More particularly, the lugs are fixed by rapidly detachable fastening means on water-containing casings 38 mounted on the small sides of the oscillating table, and inlet and outlet piping 40 leads to and from the water-containing casings for supplying cooling water to, and evacuating cooling water from, the steel cases 34 through hollow lugs 36.

Each water-containing casing 38, which bears stationary large plate 30 of the mold, is articulated on oscillating table 12 about a horizontal axis parallel to the large faces of this plate, as shown in FIG. 5. This mounting permits some movement of the water-containing casings and, subsequently, of large plate 30 with respect to the oscillating table and facilitates machining of the table and the large plate faces as well as their assembly.

As shown in FIG. 6, the other large plate 31 is displaceable perpendicularly to its plane to enable the width of the mold cavity to be changed by changing the distance between stationary plate 30 and displaceable plate 31. Therefore, water-containing casings 38 bearing large plate 31 are mounted glidably along the small sides of oscillating table 12. For this purpose, the water-containing casings have flanges glidingly retained in guide tracks affixed to the oscillating table. There is some tolerance between the flanges and the guide tracks to permit some movement of the water-containing casings and, subsequently, of large plate 31 with respect to the oscillating table.

The continuous casting machine has means for exerting a pressing force upon large plates 30, 31 for pressing them tightly against small plates 28, 29. As best shown in FIG. 2, stationary large plate 30 is held in engagement with four abutments 41 by jack means comprised of two screw jacks 42 mounted near the small sides of the oscillating table, the abutments being disposed at two different levels on the small sides of oscillating table 12. The screw jacks are disposed at a level intermediate the levels of the upper and lower abutments, preferably substantially at a level of the resultant of the hydrostatic pressure forces acting upon the large mold wall plates when the mold is in use, i.e. at two thirds of the height from the level of the liquid metal. Abutments 41 define a reference surface permitting perfect alignment of the interior face of large plate 30 with the support plane for the strand emerging from the mold defined by the exterior row of the pinch rolls of upper rack part 16. Second jack means comprised of two screw jacks 44 face jacks 42 on the other large side of oscillating table 12 and act upon other large plate 31 of the mold for holding small mold wall plates 28, 29 tightly between large mold wall plates 30, 31. The axes of jacks 42 and 44 are disposed in two vertical planes extending close to the small sides of the oscillating table and passing approximately centrally through abutments 41.

Figure 3:
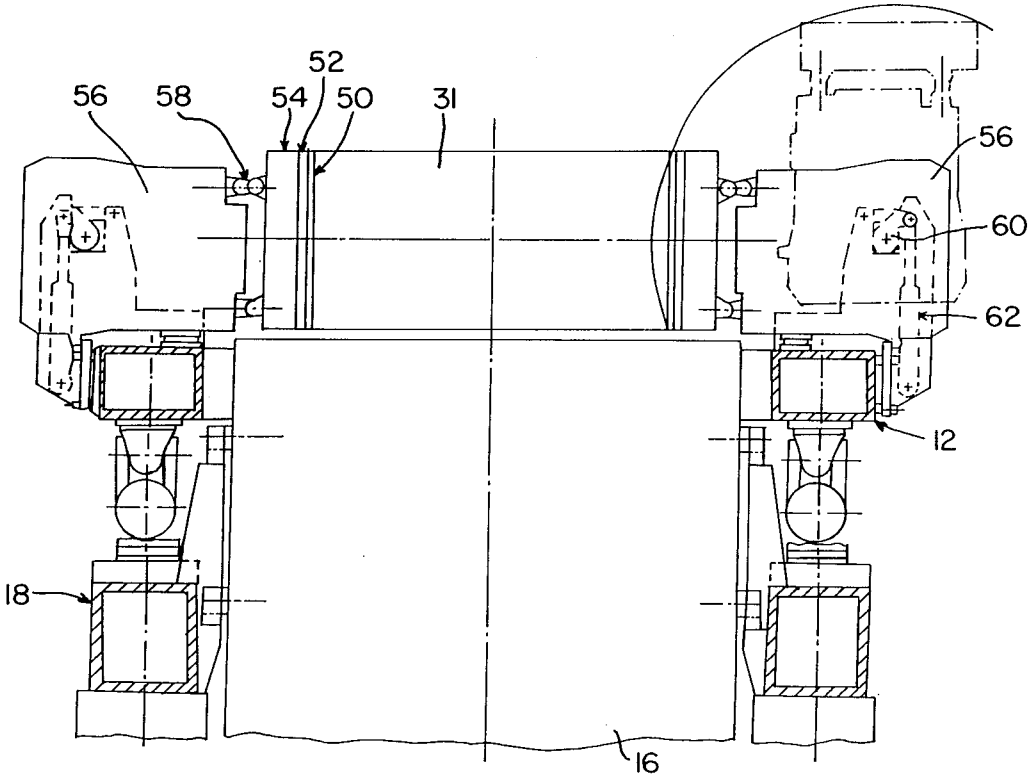
FIG. 3 is a section along line III—III of FIG. 2.

As best shown in FIGS. 2 and 3, each small mold wall plate is formed by interior copper plate 50 facing the mold cavity to form a wall thereof and fixed to support plate 52 of steel serving to impart the required rigidity to the copper mold cavity wall and to circulate cooling water to channels defined in the interior copper plate in a manner generally well known. Assembled plates 50, 52 are fixed to support plate 54 by rapidly detachable fastening means which enable water inlets and outlets in steel plate 52 to be attached to piping attached to plate 54 for supplying cooling water to the plates.

Means is mounted on the oscillating table for adjusting the position of small mold wall plates 28, 29 with respect to large mold wall plates 30, 31 and supports for the small plates are integral with the position adjusting means. In the illustrated embodiment, each support plate 54 of the small mold wall plate is fixed to an end of a support arm or arms of mechanism 56 for adjusting the small mold wall plate position, which is mounted on the adjacent small side of oscillating table 12. In the illustrated embodiment, the position adjusting mechanisms comprise two telescoping arms 58 whose length may be changed by means of power-driven screw-and-nut devices to displace the small mold wall plates and to change their inclination. Position adjusting means 56 are mounted for pivoting about horizontal axes 60 extending parallel to small plates 28, 29 and perpendicular to a longitudinal axis of the mold, and means constituted by jacks 62 enable the position adjusting means to be tilted about axes 60 for disengaging the opening of the oscillating table so that upper roll rack part 16 may be removed upwardly through this opening.

Mold wall plates 28, 29, 30 and 31 are equipped with suitable means for attachment to, and suspension from, hooks of an overhead trolley or crane. For dismounting the mold wall plates, swinging frame 64 is used to permit simultaneous disassembly of all four plates and, subsequently, upper roll rack part 16. In this operation, large plates 30 and 31 and steel plates 50 and 52 of the small plates are attached to frame 64, the rods of jacks 42 and 44 are retracted, the steel plates 50, 52 are detached from their support plates 54, lugs 36 of large plates 30, 31 are detached from water-containing casings 38, and the plates are lifted by means of the overhead crane. This procedure is reversed for replacing new mold wall plates.

Figure 4:
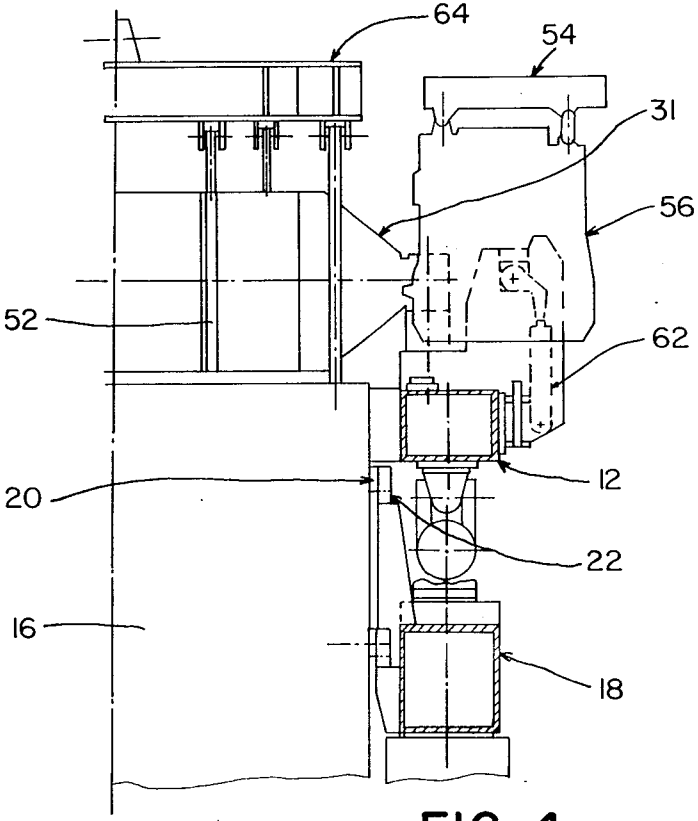
FIG. 4 shows a half of the machine in the view of FIG. 3 and illustrating the dismounting of the mold and of the upper roll rack part.

When it is desired to remove upper roll rack part 16, for example to effectuate maintenance operations or to change the spacing between the two rows of pinch rolls to obtain a different thickness of the casting, the mold wall plates must first be removed. These two operations may be effected successively or simultaneously. At any rate, steel plates 50, 52 must be detached from their support plates 54, the latter are retracted and position adjusting means 56 is tilted (see FIG. 4) by jacks 62 to disengage the opening of the oscillating table and to permit the upper roll rack part to be lifted through the opening. The pressing jacks 42 and 44 are disposed close to the small sides of oscillating table 12 so that they do not interfere with the removal of the upper roll rack part.

Water-containing casings 38, pressing jacks 42 and 44, and position adjusting means 56 are so fixed to oscillating table 12 that they may be readily detached therefrom for repair or maintenance. Instead of placing means 56 for adjusting the position of the small plates and jacks 42, 44 individually on the oscillating table, the water-containing casings and the jacks and the mechanism 56 on each side of the table may be assembled on a frame fixed to the oscillating table and constituting a detachable unit. This facilitates rapid dismounting of these means when it becomes necessary, for example when they have become damaged due to an escape of molten steel. Each of these elements could also be mounted on a frame of the same shape and dimension as the oscillating table and fixed detachably thereto.

Also, instead of being borne by water-containing casings on the oscillating table, the large mold wall plates could rest directly on the table or on frames carrying the pressing jacks for the large mold wall plates and the position adjusting mechanisms for the small mold wall plates, the cooling water piping being attached to the large plates by rapidly detachable or other known connecting means.

Furthermore, instead of being pivotally mounted, position adjusting mechanisms 56 could be mounted on gliding tracks for being rectilinearly moved away from the oscillating table opening. In case only small variations in the width of the castings are desired, it may be sufficient to retract only the supports for the small mold wall plates instead of displacing the entire position adjusting mechanism for disengaging the oscillating table opening.

While the invention has been described in connection with now preferred embodiments thereof, it will be understood that many variations and modifications may occur to those skilled in the art without departing from the spirit and scope of this invention as defined in the appended claims.

What is claimed is:

1. A continuous casting machine for producing slabs, which comprises (a) an oscillating table constituted by a rectangular frame having large sides and small sides defining an opening, (b) a mold carried by the oscillating table in alignment with said opening and consisting of two opposing large plates and two opposing small plates held tightly between the large plates, (c) means for adjusting the position of the small plates with respect to the large plates, (d) supports for the small plates integral with the position adjusting means, (e) means for exerting a pressing force upon the large plates for pressing them tightly against the small plates, (1) the large plates, the position adjusting means and the means for exerting the pressing force being mounted on the oscillating table, and (f) a curved roll rack disposed below the oscillating table.

2. The continuous casting machine of claim 1, wherein the means for exerting the pressing force are disposed adjacent the small sides of the oscillating table and the position adjusting means are arranged to be retracted for permitting an upper part of the curved roll rack to be removed vertically upwardly across the oscillating table.

3. The continuous casting machine of claim 1, wherein the oscillating table has an abutment and means for exerting the pressing force comprises first jack means pressing one of the large plates against the abutment, the abutment defining a reference surface, and second jack means acting upon the other large plate for holding the small plates tightly between the large plates.

4. The continuous casting machine of claim 1, wherein the position adjusting means are mounted for pivoting about axes extending parallel to the small plates and perpendicular to a longitudinal axis of the mold, and further comprising means for tilting the position adjusting means about the axes extending parallel to the small plates for disengaging the oscillating table opening.

5. The continuous casting machine of claim 1, further comprising hollow lugs at respective opposite ends of the large plates, water-containing casings mounted on the small sides of the oscillating table, the lugs bearing on the water-containing casings, and inlet and outlet piping leading to and from the water-containing casings for supplying cooling water to, and evacuating the cooling water from, the casings and through the hollow lugs to and from the large plates.

6. The continuous casting machine of claim 5, wherein the lugs detachably connect the large plates to the water-containing casings, the water-containing casings being mounted on the oscillating table for movement with respect to the table.

* * * * *